US005311644A

United States Patent [19]

Laforgerie

[11] Patent Number: 5,311,644

[45] Date of Patent: May 17, 1994

[54] HINGE HAVING STOP NOTCHES FOR A DOOR, PARTICULARLY A CAR DOOR

[75] Inventor: Armand Laforgerie, Chilly-Mazarin, France

[73] Assignee: MGI Coutier S.A., France

[21] Appl. No.: 952,854

[22] PCT Filed: Jun. 20, 1990

[86] PCT No.: PCT/FR90/00448

§ 371 Date: Nov. 25, 1992

§ 102(e) Date: Nov. 25, 1992

[87] PCT Pub. No.: WO91/19876

PCT Pub. Date: Dec. 26, 1991

[51] Int. Cl.[5] ..... E05D 11/02; E05D 11/10

[52] U.S. Cl. ..... 16/334; 16/250; 16/344; 16/347; 16/274

[58] Field of Search ..... 16/334, 344, 347, 273, 16/250, 274

[56] References Cited

U.S. PATENT DOCUMENTS

| | | | |
|---|---|---|---|
| 1,269,764 | 6/1918 | Weaver | 16/334 |
| 2,587,781 | 3/1952 | Stanfield et al. | 16/334 |
| 3,351,976 | 11/1967 | Gionet . | |
| 4,064,652 | 12/1977 | Johnston . | |
| 4,332,056 | 6/1982 | Griffin et al. | 16/347 |
| 4,670,941 | 6/1987 | Peterson | 16/334 |
| 4,672,715 | 6/1987 | Beckwith | 16/334 |
| 4,829,633 | 5/1989 | Kassner | 16/334 |

FOREIGN PATENT DOCUMENTS

| | | | |
|---|---|---|---|
| 0249830 | 12/1987 | European Pat. Off. . | |
| 1804827 | 5/1970 | Fed. Rep. of Germany . | |
| 2089301 | 7/1972 | France . | |
| 2195996 | 8/1974 | France . | |
| 5989 | of 1889 | United Kingdom | 16/334 |

*Primary Examiner*—Lowell A. Larson
*Assistant Examiner*—Donald M. Gurley
*Attorney, Agent, or Firm*—Davis, Bujold & Streck

[57] ABSTRACT

A door hinge having a particularly reliable and solid stop and holding device. The movable part (13) of the hinge lies along the hinge pin (1) between the fixed part (14) and a housing (17) which contains the holding mechanism and is integral with the fixed part (14). In the housing, a pivotable lever (19) is rotationally fastened to the movable part (13) and supports a roller (26) against which one or more notches (42, 45) are pushed by a spring-loaded device (31, 40). The notches define the open positions of the door (11). The housing (17) is sealed and fits onto the fixed part and the hinge pin. The hinge can be used particularly in motor vehicle doors.

15 Claims, 3 Drawing Sheets

HINGE HAVING STOP NOTCHES FOR A DOOR, PARTICULARLY A CAR DOOR

Figure 1:
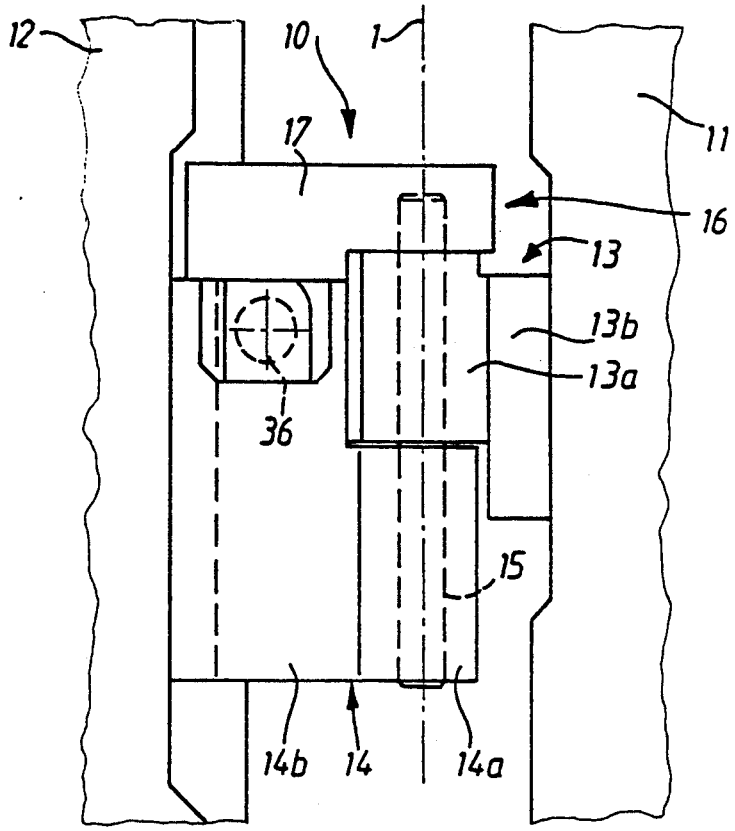

The present invention concerns a hinge having stop notches for a door, particularly a car door, comprising a fixed part, a movable part fixed to the door and hinged to the fixed part by means of a pin in such a way as to pivot with the door around the hinge pin, and a holding mechanism with stop notches which is connected to the said parts of the hinge and fitted with elastic elements which form at least one stop notch to hold the door in the corresponding open position.

Hinges of this type are well known and are generally seen between a vehicle door and the door surround. These traditional hinges are totally unprotected from the outside elements and are mechanically integrated with the other parts of the hinge. Since they require lubrication they also present the risk of dirtying the clothes of users getting in and out of the vehicle.

The aim of the present invention is to overcome the above mentioned drawbacks of the classic automobile hinges, by providing a hinge which have the same mechanical functions as the said traditional hinges, but which is protected from external influences.

In this aim, a hinge according to the invention is characterized in that it comprises a housing containing the holding mechanism and rotationally fastened to the first of the said parts, and a supporting element, rotationally fastened to the second part and extending inside the housing in such a way as to engage with the said mechanism.

On preference, the supporting element have a rear extremity containing an axial bore, comprises non-circular external surfaces and is fitted axially in a housing with a corresponding non-circular shape, fitted around the pin in the second part of the hinge.

In the preferred embodiment, the front extremity of the supporting element is fitted with a freely rotating roller, engaging with notches of the holding mechanism.

In a first aspect, the holding mechanism comprises two notches formed by concave surfaces on a pivoting part with axis parallel to the hinge pin and at least one pair of springs compressing this part in opposing rotational directions in such a way as to maintain the said pivoting part in a median point when the roller is not pressing against one of the notches.

In a second aspect, the holding mechanism comprises a cam lever, with a toothed edge pressing against the roller and fitted with notches and a pivoting part fitted with a push pulling the opposite side of the cam lever, the pivoting part being pushed by the said elastic elements.

The housing is preferably fitted with a cover, transversally positioned with respect to the hinge pin and ensuring the impervious enclosure of the holding mechanism.

The housing is generally fixed to the fixed part of the hinge, and the supporting element is rotationally fastened to the movable part.

The said movable part is preferably placed along the pin, between the fixed part and the housing. The housing may include two external, parallel lugs, disposed on either side of the fixed part of the hinge and fitted with at least one locking screw.

Figure 2:
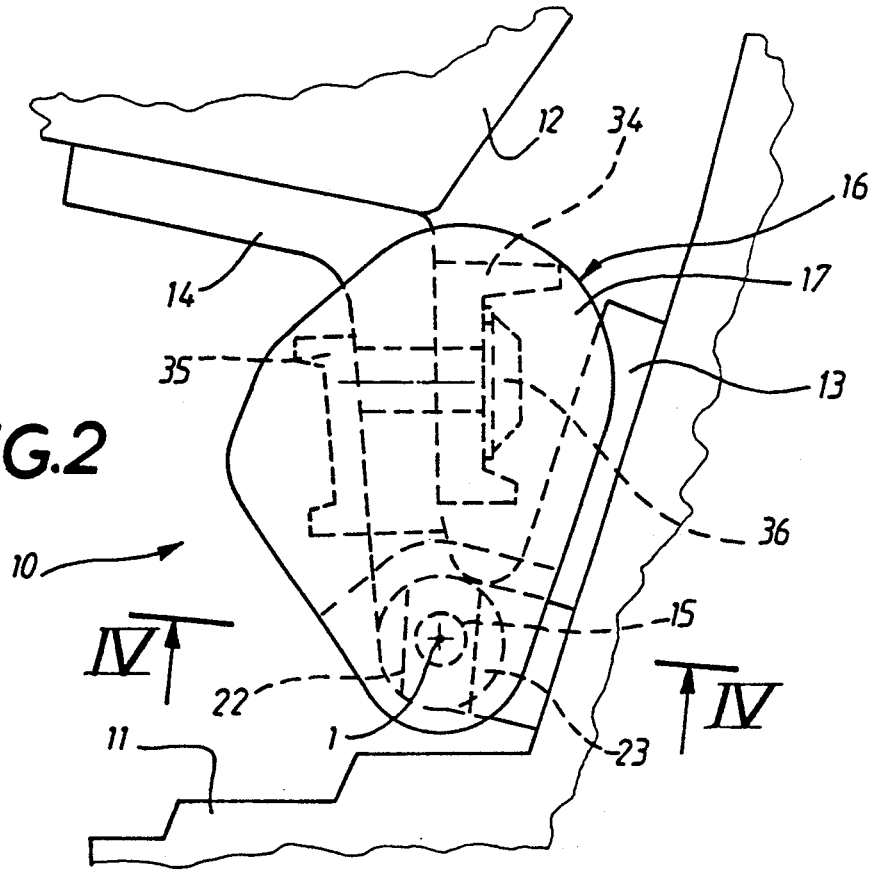
Figure 3:
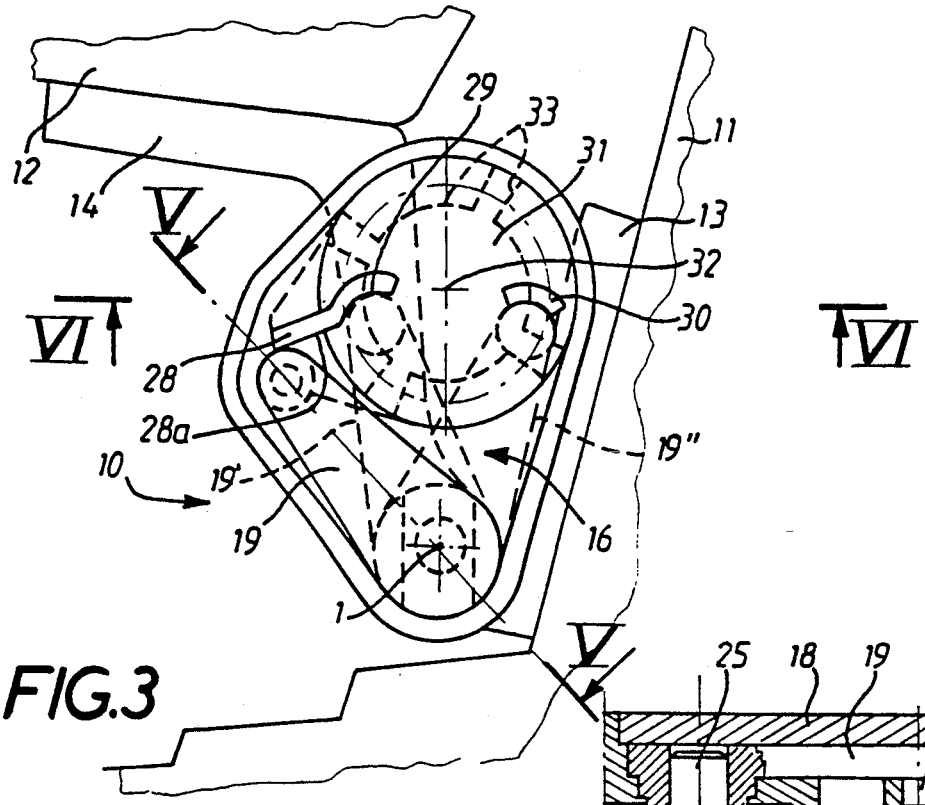
Figure 5:
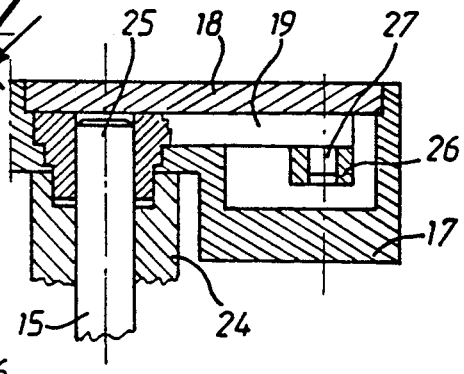
Figure 4:
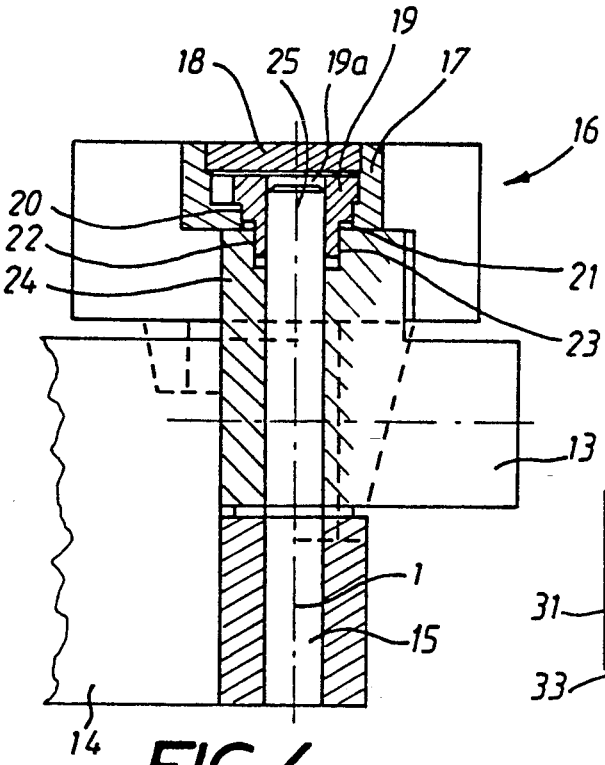
Figure 6:
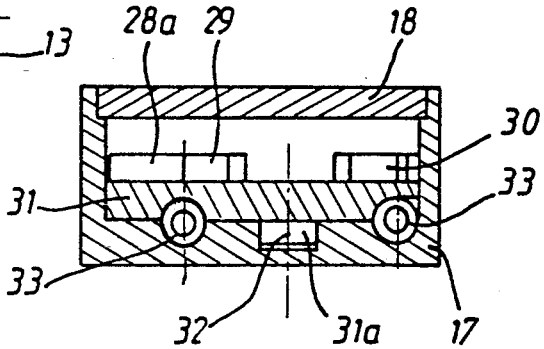
Figure 7:
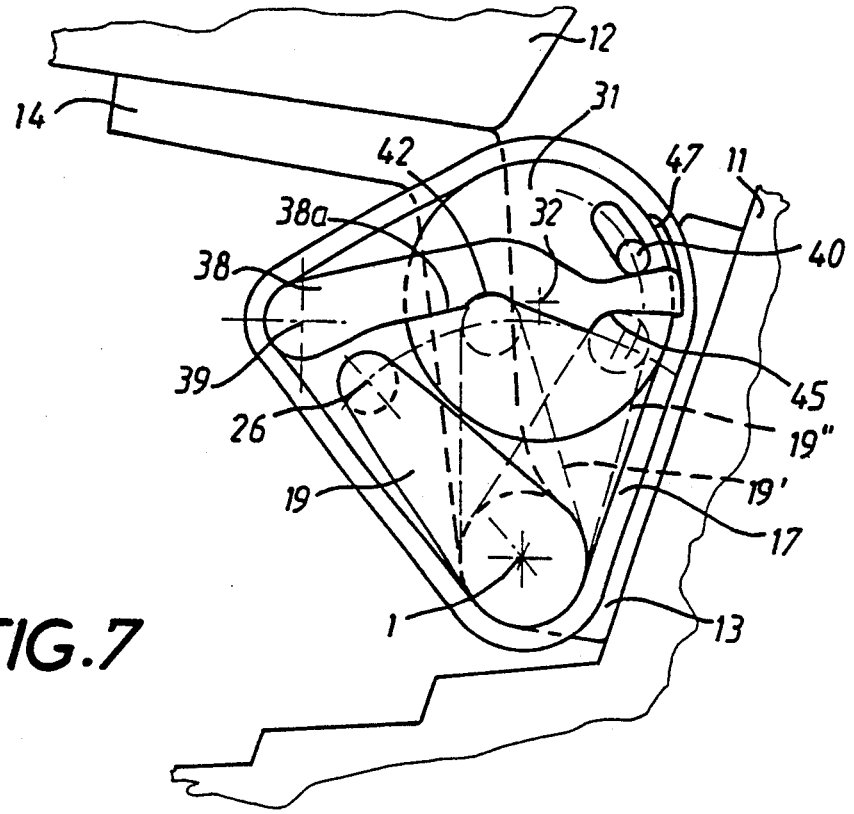
Figure 8:
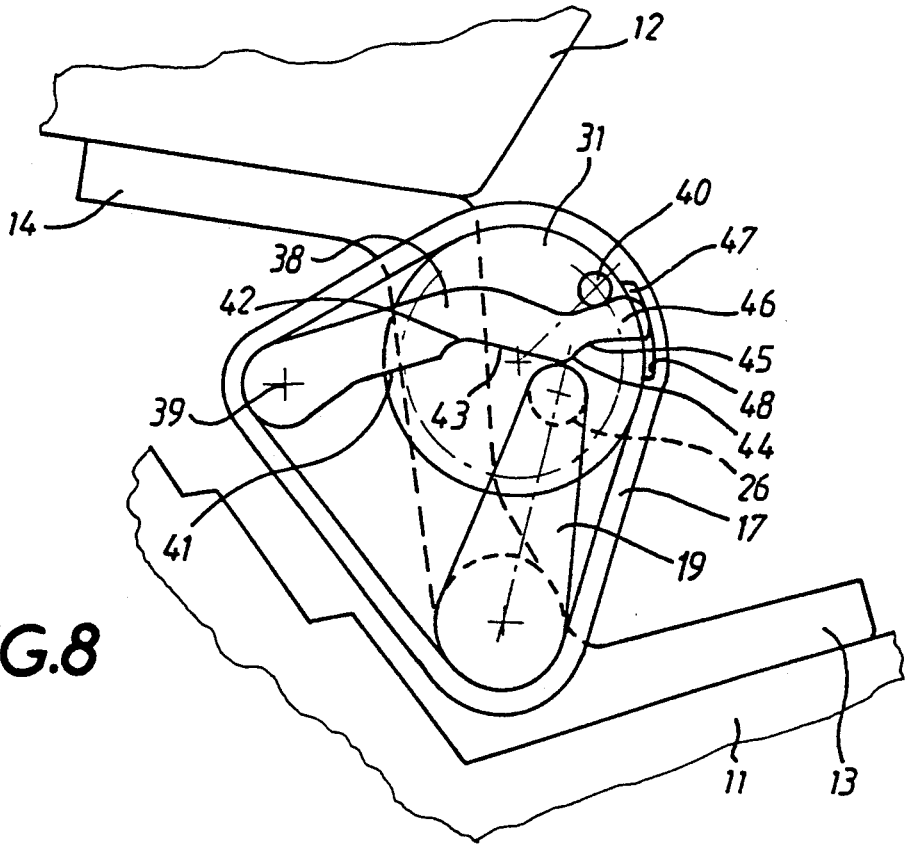

The present invention will be more easily understood with the aid of the following description of embodiment examples, referring to the attached drawings, where :

FIG. 1 is a schematic elevation view showing a car door hinge realized according to the invention, FIG. 2 is a plane view of the hinge shown in FIG. 1, FIG. 3 is a similar view to that of FIG. 2, after the upper hinge cover has been removed, to show the stop notch mechanism, FIG. 4 is a partial cross-section view along the line IV—IV of FIG. 2, FIG. 5 is a partial cross-section view along the line V—V of FIG. 3, FIG. 6 is a partial cross-section view along the line VI—VI of FIG. 3, and FIGS. 7 and 8 are similar views to FIG. 3 and represent another embodiment of the door holding mechanism in two different positions.

FIGS. 1 to 6 represent a first embodiment of a hinge 10 with vertical or inclined axis 1, which with a second hinge of the same axis permits the rotatable articulation of a car door 11 on a fixed part of the vehicle body, normally constituted by a part 12, called the door post. Traditionally, the hinge 10 includes a movable part 13, comprising a tubular element called the knuckle **13*a* and a hinge 13*b* fixed to the door 11, and a fixed part 14, comprising a knuckle 14*a* and a hinge 14*b* fixed to the door post 12, the movable part 13 resting on the fixed part 14 and being rotatably articulated with it by means of a cylindrical pin 15** fixed to one of the two knuckles.

In addition, the hinge is fitted with a stop device 16, which enables the door to be maintained in at least one open position. In this example, the device has two notches for the definition of two open positions, as is normally the case, but this number is not limitative. The stop device 16 is fitted into a housing 17, closed by a cover at the top 18 and fixed to the fixed part of the hinge 14 by a screw 36. The housing 17 covers the upper extremity of the pin 15, so that the mobile knuckle **13*a* cannot be raised and is surrounded by the fixed part 14 and the housing 17**.

In the housing 17, a lever 19 is rotatably articulated by means of a bearing 20 in the cylindrical bore 21 of the housing. As shown in FIG. 4, this lever comprises a lower part fitted with two opposing lateral plates, 22 and 23, fitted vertically into the upper part 24, of the mobile knuckle **13*a* extending into the inside of the housing 17. The lever 19 has a vertical bore 19*a* which is fitted to one upper extremity 25 of the pin 15 and which therefore centres the lever and its bearing on the pin and its axis 1. Thus, when the door is pivoted, the lever 19 is pushed by pressure on its plates, 22 and 23, and it pivots in the same way. At the same time, its free extremity, fitted with a roller 26, freely rotating on a stud 27 on the internal face of the lever, engages with a stop notch mechanism lodged inside the housing 17**.

The holding mechanism, in order to press on the roller 26, comprises a first blade 28 fitted with a lateral ramp **28*a* and a concave surface defining a first notch 29, and a second blade fitted with a concave surface forming a second notch 30. These two blades are fixed to a disc 31, mounted in the housing in such a way as to pivot around its central axis 32, by means of a cylindrical stud 31*a* fitted under the disc and engaged into a corresponding bore in the housing. Semi-circular grooves are made, following a circular line on the underside of the disc 31 and in the opposite surface of the housing 17**, to house two pairs of compression springs 33, which are opposed two by two and help to maintain the disc 31 in a median position. The springs 33 are positioned under compression and thus exert a permanent force on the disc which is elastically opposed to the rotation of the disc in both directions.

In FIG. 3, the position of the lever 19 drawn as a single line, corresponds to the closed position of the door 11. Its position 19' defined by the first notch 29 corresponds to a first open position, where the door is only slightly open, and its position 19" defined by the second notch 30 corresponds to a second position, in which the door opening is at a maximum and can be limited, e.g by stopping the roller 26 against a wall of the housing 17. When the door is opened, the roller 26 rolls on the ramp 28*a* and makes the disc 31 pivot in a clockwise direction, pushing the first blade 28, until it lodges in the first notch 29. If the opening movement is continued, the disc 31 moves back to its median position when the roller is between notches 29 and 30; then it pivots in an anti-clockwise direction when the roller pushes behind notch 30. During closure of the door 11, the movements are similar, but the inverse of those just described for the opening. With such a mechanism, the shape and installation of the elements 28, 29 and 30 pushing the roller are completely free and allow the respective forces pressing on the two notches 29 and 30 to be chosen independently.

The housing 17 has two opposing fastening lugs 34 and 35 on its internal face, which allow it to be fixed across the fixed 14 of the hinge, with only one transverse screw 36 for example. Thus mounting and removal of the hinge are particularly simple. The housing 17 should preferably be sealed by the cover 18, thanks to an appropriate gasket which is not shown, and it can also be fitted imperviously to the upper part 24 of the mobile knuckle, so that the holding mechanism is protected against the effects of water, of dirt, and can notably be lubricated for life. In addition, the vehicle's users do not risk dirtying themselves if they accidentally come into contact with the hinge.

FIGS. 7 and 8 represent a variation of the holding mechanism engaging with the roller 26 of the pivoting lever 19. As in the previous example, pressure against the roller is ensured by the disc 31 pivoting under the action of the springs 33 shown in FIGS. 3 and 6, or by an equivalent element capable of pivoting about the axis 32 under the action of a spring. In the present case, the element of the mechanism pressing against the roller 26 is a lever 38 which has one extremity articulated about an axis 39 in the housing 17, whilst its other extremity is pushed in the direction of the roller 26 by a stud 40 carried on the disc 31. The edge of the lever 38 on which the roller 26 rolls, constitutes a cam comprising a ramp 41, a first notch 42 formed by a concave surface, a second ramp 43, extending to a point 44, and a second notch 45 formed by a concave surface. The free extremity 46 of the cam lever 38 slides in a groove 47 cut in the housing and one extremity 48 of which serves as a stop for the lever 38. The positions 19' and 19" of the lever 19, defined by the notches 42 and 45, correspond to those in the previous example. On the other hand, the use of the cam lever 38 allows continuous contact between the roller 26 and the surface of the cam to be maintained, except when the door is closed. The shape of the cam 38*a*, can be freely chosen.

The present invention is not limited to the above mentioned embodiments, but extends to any modification or variation obvious to one skilled in the art. In particular, it is obvious that the stop device 16 could be fixed to the movable part of the hinge instead of to the fixed part, or could be fitted at the lower end of the pin 15 instead of at the upper end. This device could be fitted to both door hinges or to one only, according to the force to be exerted and the space available. The parts of the device can be manufactured in any appropriate material, particularly in metal or synthetic material in the form of moulded parts, and the device can be manufactured and delivered as an independent unit, for adaptation to a hinge manufactured elsewhere. It should also be noted that the mechanism in the housing can be designed differently, for example if the surface of the cam is made on a pivoting element instead of the lever 19, whilst a corresponding pressure roller is fitted in the housing, on a movable part compressed by one or more springs.

I claim:

1. A hinge for a door having at least one stop notch, said hinge comprising:

a fixed part attachable to a door frame;

a movable part being secured to a door (11) and rotatably articulated to said fixed part via a hinge pin (15) to allow said movable part to pivot with said door about said hinge pin, a notch mechanism (16) interacting with said fixed and movable parts and having at least one stop notch for maintaining said door in at least a partially open position, a housing (17) containing said mechanism (16) and being fastened to one of said fixed and movable parts (13, 14), and a lever (19) being located within said housing (17) and being fastened to the other of said fixed and movable parts (13, 14), said lever (19) having an axial bore (19*a*) engaging said pin (15), and a first end of said lever (19) being engagable with said mechanism, wherein a pivotable part (31) is located in said housing and has a rotational axis (32) which extends parallel to a longitudinal axis of said hinge pin (15), said mechanism comprises at least first and second notches (29, 30) formed by concave surfaces which are supported by said pivotable part (31), and a biasing mechanism (33) biases said pivotable part (31) to a central pivot position so that said pivoting part initially pivots in a first direction as said lever (19) engages said first notch (29) and pivots in a second opposite direction initially as said lever (19) engages said second notch (30).

2. A hinge according to claim 1 wherein one end of said lever (19) supports a freely rotatably roller (26) which is engagable with said first and second notches (29, 30, 42, 45).

3. A hinge according to claim 1 wherein a second opposite end of said lever (19) includes said axial bore (19*a*) and said axial bore (19*a*) is at least partially defined by two external surfaces (22, 23) which are fitted axially into a housing of said movable part (13).

4. A hinge according to claim 1 wherein said housing (17) includes a cover (18) disposed substantially perpendicular to said hinge pin (15) to form an impervious cover for said mechanism (16).

5. A hinge according to claim 1 wherein said housing (17) is fixed to said fixed part (14) and said lever (19) is fastened to said movable part (13).

6. A hinge according to claim 5 wherein said movable part (13) is located along said pin (15) between said fixed part (14) and said housing (17).

7. A hinge according to claim 5, wherein said housing includes two external lugs (34, 35) which are disposed parallel to one another and on opposite sides of said fixed part (14), and said two external lugs (34, 35) are secured to said fixed aprt (14) by at least one screw (36).

8. A hinge for a door having at least one stop notch, said hinge comprising:

a fixed part attachable to a door frame;

a movable part being secured to a door (11) and rotatably articulated to said fixed part via a hinge pin (15) to allow said movable part to pivot with said door about said hinge pin, a notch mechanism (16) interacting with said fixed and movable parts and having at least one stop notch for maintaining said door in at least a partially open position, a housing (17) containing said mechanism (16) and being fastened to one of said fixed and movable parts (13, 14), and a first lever (19) being located within said housing (17) and being fastened to the other of said fixed and movable parts (13, 14), said first lever (19) having an axial bore (19*a*) engaging said pin (15), and a first end of said first lever (19) being engagable with said mechanism, wherein said mechanism comprises a cam lever (38) which has a cam surface (38*a*, 43) provided with first and second notches (42, 45), a first end of said first lever (19) is pivotable supported by said housing, and a biasing mechanism biases a second opposed end of said cam lever (38) toward said first lever (19) for engagement with the first lever (19) as the door is moved to an opened position.

9. A hinge according to claim 8 wherein one end of said first lever (19) supports a freely rotatable roller (26) which is engagable with said first and second notches (29, 30, 42, 45).

10. A hinge according to claim 8 wherein an opposite end of said first lever (19) includes said axial bore (19*a*) and said axial bore (19*a*) is at least partially defined by two external surfaces (22, 23) which are fitted axially into a housing of said movable part (13).

11. A hinge according to claim 8 wherein said housing (17) includes a cover (18) disposed substantially perpendicular to said hinge pin (15) to form an impervious cover for said mechanism (16).

12. A hinge according to claim 8 wherein said housing (17) is fixed to said fixed part (14) and said first lever (19) is fastened to said movable part.

13. A hinge according to claim 12 wherein said movable part (13) is located along said pin (15) between said fixed part (14) and said housing (17).

14. A hinge according to claim 12 wherein said housing includes two external lugs (34, 35) which are disposed parallel to one another and on opposite sides of said fixed part (14) and said two external lugs (34, 35) are secured to said fixed part (14) by at least one screw (36).

15. A hinge according to claim 12 wherein a pivoting part (31) has a rotational axis (32) which extends parallel to a longitudinal axis of said hinge pin (15) and said pivoting part (31) supports a stud (40) which biases, via said biasing mechanism, the second opposed end of said cam lever (38) toward said first lever (19).

* * * * *